US009400105B2

(12) United States Patent
Genin et al.

(10) Patent No.: US 9,400,105 B2
(45) Date of Patent: Jul. 26, 2016

(54) PREMIX BURNER

(71) Applicant: ALSTOM Technology Ltd, Baden (CH)

(72) Inventors: Franklin Marie Genin, Baden (CH); Marcel Rieker, Niedergösgen (CH); Bettina Paikert, Oberrohrdorf (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 252 days.

(21) Appl. No.: 14/014,757

(22) Filed: Aug. 30, 2013

(65) Prior Publication Data

US 2014/0065562 A1 Mar. 6, 2014

(30) Foreign Application Priority Data

Aug. 31, 2012 (EP) ..... 12182600

(51) Int. Cl.

| | |
|---|---|
| ***F23D 14/62*** | (2006.01) |
| ***F23D 14/02*** | (2006.01) |
| ***F23R 3/28*** | (2006.01) |
| ***F23D 17/00*** | (2006.01) |

(52) U.S. Cl.

CPC ..... *F23D 14/02* (2013.01); *F23D 14/62* (2013.01); *F23D 17/002* (2013.01); *F23R 3/286* (2013.01); *F23C 2900/07002* (2013.01); *F23D 2900/14021* (2013.01)

(58) Field of Classification Search

CPC ..... F23D 14/62; F23D 14/02
USPC ..... 431/350, 354, 351
See application file for complete search history.

(56) References Cited

U.S. PATENT DOCUMENTS

| | | | | |
|---|---|---|---|---|
| 2,647,568 | A * | 8/1953 | Sloan | 431/183 |
| 5,240,410 | A | 8/1993 | Yang et al. | |
| 5,433,596 | A * | 7/1995 | Dobbeling et al. | 431/350 |
| 5,588,826 | A | 12/1996 | Döbbeling et al. | |
| 5,673,551 | A | 10/1997 | Döbbeling | |

(Continued)

FOREIGN PATENT DOCUMENTS

| | | |
|---|---|---|
| DE | 195 27 453 | 1/1997 |
| DE | 19545310 | 6/1997 |

(Continued)

OTHER PUBLICATIONS

Office action issued from Japanese Patent Office dated Jul. 21, 2015 for JP Application No. 2013-181240.

*Primary Examiner* — Avinash Savani
(74) *Attorney, Agent, or Firm* — Buchanan Ingersoll & Rooney PC

(57) ABSTRACT

This invention relates to a premix burner for operating a heat generator, the burner at least having a swirl generator, a mixing section downstream of the swirl generator and a transition piece for transferring the swirl flow from the swirl generator into the mixing section. The invention further refers to a transition piece for such a premix burner. The transition piece includes an inlet, connected to the swirl generator, an outlet, connected to the mixing tube, and a continuing flow limiting interior contour between said inlet and said outlet, wherein at least in an inlet section said interior contour is curved radially inwards towards the inner diameter of the mixing tube and wherein at the outlet the interior contour is flush with an interior flow limiting contour of the mixing tube.

12 Claims, 3 Drawing Sheets

(56) References Cited

U.S. PATENT DOCUMENTS

| | | | | |
|---|---|---|---|---|
| 5,735,687 | A | 4/1998 | Knöpfel et al. | |
| 5,984,670 | A | 11/1999 | McMillan et al. | |
| 6,126,439 | A | 10/2000 | Knöpfel et al. | |
| 6,331,109 | B1 * | 12/2001 | Paikert et al. | 431/350 |
| 7,632,091 | B2 | 12/2009 | Steinbach et al. | |

FOREIGN PATENT DOCUMENTS

| | | | |
|---|---|---|---|
| DE | 202008009650 | U1 | 11/2009 |
| EP | 0 321 809 | | 6/1989 |
| EP | 0 704 657 | | 4/1996 |
| EP | 0 780 629 | | 6/1997 |
| EP | 0 849 528 | | 6/1998 |
| EP | 0 849 530 | | 6/1998 |
| EP | 1 359 376 | | 11/2003 |
| EP | 2 208 927 | | 7/2010 |
| JP | H07-310909 | | 11/1995 |
| JP | H10-103620 | | 4/1998 |
| JP | 2007-504429 | | 3/2007 |
| JP | 2011-515641 | | 5/2011 |
| RU | 2115064 | C1 | 7/1998 |
| RU | 2187756 | C1 | 8/2002 |
| WO | 2005/078348 | | 8/2005 |
| WO | 2006094939 | | 9/2006 |

* cited by examiner

FIG. 3
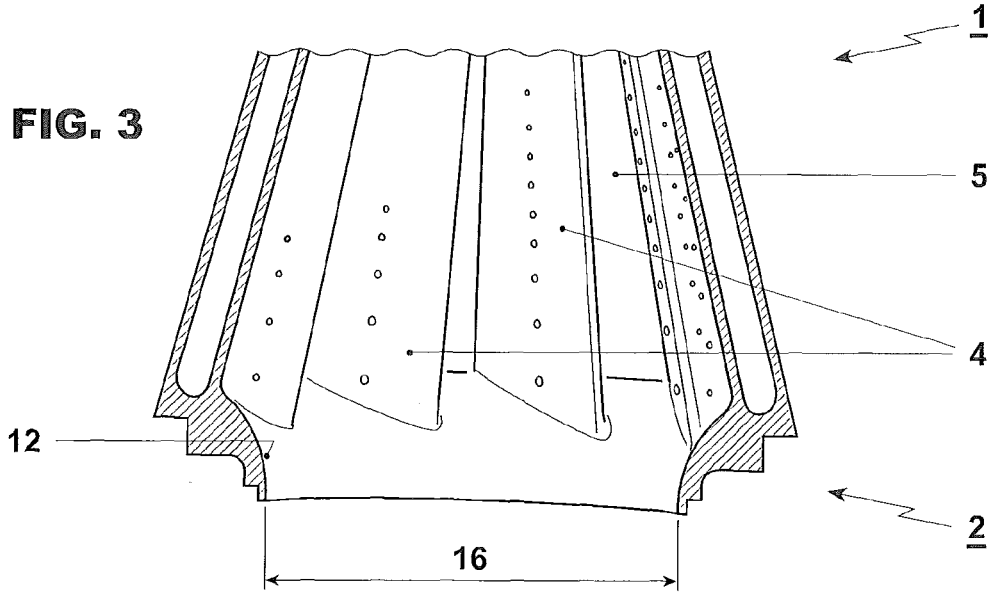
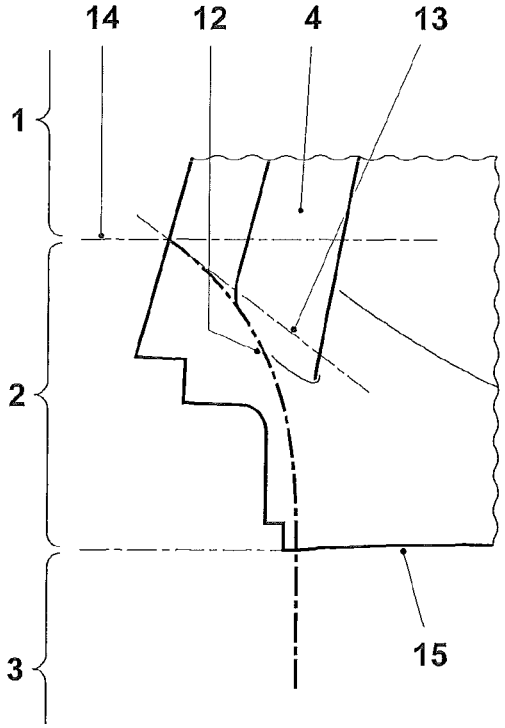
FIG. 4a
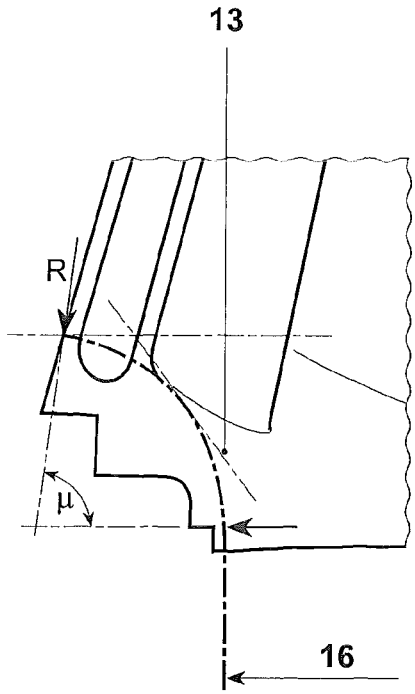
FIG. 4b

PREMIX BURNER

CROSS-REFERENCE TO RELATED APPLICATIONS

This application claims priority to European Application 12182600.2 filed Aug. 31, 2012, the contents of which are hereby incorporated in its entirety.

TECHNICAL FIELD

This invention relates to a premix burner for operating a heat generator, the burner at least having a swirl generator, a mixing section downstream of the swirl generator and a transition piece for transferring the swirl flow from the swirl generator into the mixing section. The invention further refers to a transition piece for such a premix burner.

BACKGROUND ART

Premix burners of the above-mentioned generic type are known from a number of publications, for example EP 704657, EP 780629.

Premix burners of this type are based on the common operating principle of injecting combustion air and a gaseous and/or liquid fuel into a conically designed swirl generator, mixing therein and generating a swirl flow of a fuel/air mixture, wherein the swirl generator provides at least two conical half shells assembled with a mutual overlap for forming tangential inlet slots for fuel and air. Downstream of the swirl generator is arranged the mixing zone for homogeneously mixing fuel and air before ignition occurs. Ignition and combustion of the mixture occur inside the combustion chamber with a premix flame. Due to the discontinuous transition from the burner into the combustion chamber at the burner outlet the swirl flow becomes instable and ultimately breaks down into an annular flow with a central recirculation zone, in the forward region of which the premix flame forms. The spatial position of the premix flame is determined by the aerodynamic behavior of the swirl flow at the outlet of the mixing zone.

The flow from the swirl generator is directed into the mixing zone via a transition piece.

Transition pieces have been disclosed in EP 1714081 or in WO 2006094939. FIG. 2 is a replica of FIG. 7 of EP 1714081. The cone shell segments 4 of the swirl generator 1 are placed with respect to a burner axis A extending centrally through the premix burner. The cone shells 4 delimit a swirl space conically widening in the direction of flow. In each case two shell segments 4, arranged adjacent to one another, enclose an air inlet slot 5, through which an air flow penetrates into the swirl space. Each individual cone shell segment 4 has a fuel supply line 6 for admixing fuel into the incoming air flow passing through the air inlet slots 5. The individual cone shell segments 4 open out with their downstream end on an inside wall 7 of the transition piece 2. Along a line of intersection 8 the individual cone shells 4 are connected to the inner wall 7 of the transition piece 2. This wall 7 may comprise a frustoconical portion tapering conically in downstream direction.

Current transition pieces share the problem that sharp edges have to be included to guide the swirling flow from an angular discharge cross-section to a circular cross-section. In the past these transition pieces have been found to be a major contributor to the risk of flashback due to streaks of low velocity or of early self-ignition by the creation of local recirculation zones. The shape and characteristics of the end region of the swirler are an important parameter to the overall burner robustness.

SUMMARY

The present invention focuses on the optimization of the transition piece between the swirl generator and the mixing zone for avoiding the above-mentioned disadvantages of known transition pieces. It is an object of this invention to provide a smooth transition of the flow limiting contours from the swirl generator into the mixing zone. This and other objects of the invention are obtained by means of the subject matter of the independent claims. Advantageous embodiments are given in the dependent claims.

The invention is based on the main concept to replace the downstream end of the swirl generator, which extends the protruding shell trailing edges into the mixing zone, using a sharp-edges transition piece (see e.g. EP 1714081, FIG. 5), by an increase in the swirler diameter and the addition of a radial transition section, wherein the radial transition section is added in order to provide a radial velocity component to the incoming flow at the downstream end of the slots and to provide a smooth transition to the mixing tube inner wall.

An important aspect of the invention relates to a premix burner for a heat generator, essentially comprising

- a swirl generator, having at least two burner shells which complement one another to form an axially conically widening swirl space and which mutually define, in axial cone longitudinal direction, tangential slots through which combustion air is introduced into the swirl space, and means for feeding a fuel into the combustion air flow arranged at least in sections along the tangential slots,
- a mixing tube downstream of the swirl generator for homogeneously mixing fuel and combustion air before introducing the fuel-air-mixture into a combustion chamber, where ignition occurs,
- a transition piece between the swirl generator and the mixing tube for transferring the flow of combustion air and fuel from the swirl generator into the mixing tube, wherein the transition piece comprises an inlet, connected to the swirl generator, an outlet, connected to the mixing tube, and a continuing flow limiting interior contour between said inlet and said outlet,
- wherein at least in an inlet section said interior contour is curved radially inwards towards the inner diameter of the mixing tube and wherein at the outlet the interior contour is flush with an interior wall of the mixing tube.

Another aspect of the invention relates to a transition piece for a premix burner, wherein the premix burner essentially comprises

- a swirl generator, having at least two burner shells which complement one another to form an axially conically widening swirl space and which mutually define, in axial cone longitudinal direction, tangential slots through which combustion air is introduced into the swirl space, and means for feeding a fuel into the combustion air flow arranged at least in sections along the tangential slots,
- and wherein the transition piece is designed to be connected to the outlet of the swirl generator of this premix burner,
- wherein said transition piece at least comprises a casing with an inner passage, an inlet, an outlet and a continuing flow limiting interior contour between said inlet and said outlet,
- wherein at least in the inlet section said interior contour is curved radially inwards.

The radially inwards curved inlet section of the transition piece starts from the leading edge of the slots at the downstream end of the swirl generator.

By this means a radial velocity component is imposed on the incoming flow of combustion air and fuel.

According to a preferred embodiment of the invention the interior contour at the inlet of the transition piece is equipped with a concave shape.

According to a particularly preferred embodiment of the invention the interior contour at the inlet of the transition piece is equipped with a circular arc profile.

The advantage of this measure is a simplified design.

According to one aspect of the invention the radially inwards curved section of the flow limiting interior contour extends up to the outlet of the transition piece, being flush with the inlet diameter of the mixing tube.

According to an alternative aspect of the invention the radially inwards curved section of the interior contour ends in a section upstream of the outlet, and from this upstream section the interior contour continues at a constant diameter to the outlet.

This invention focuses on improvements of the burner to prevent local recirculations and low velocity regions in the flow path, thereby reducing the risk of flashback. It is an essential fact, that the run of the interior contour in the transition piece has no point of abrupt inflection, thus avoiding the risk of flow separation. This is an important advantage, in particular when operating the burner with medium or highly reactive fuels.

The disclosed transition geometry produces an increase of the axial velocity profile toward the center of the mixing tube so that the risk of premature ignition is minimized.

This invention is applicable to any type of "conical burner", irrespective of the nominal diameter or the cone angle. Burners of diameters less than 180 mm and cone angles lower than 20° are typically considered in this invention, though the present invention is not limited to the dimension of a burner.

For a person skilled in the art "conical burner" is a common technical term. Conical burners are disclosed, for example, in EP 321809, in EP 704657 or in EP 780629.

BRIEF DESCRIPTION OF THE DRAWINGS

By way of example, an embodiment of the present disclosure is described more fully hereinafter with reference to the accompanying drawings, in which:

FIG. 3 shows a perspective view of a transition piece according to the invention;

FIG. 4*a,b* show in sectional side views two exemplary embodiments of a transition piece according to the invention;

DETAILED DESCRIPTION

Figure 1:
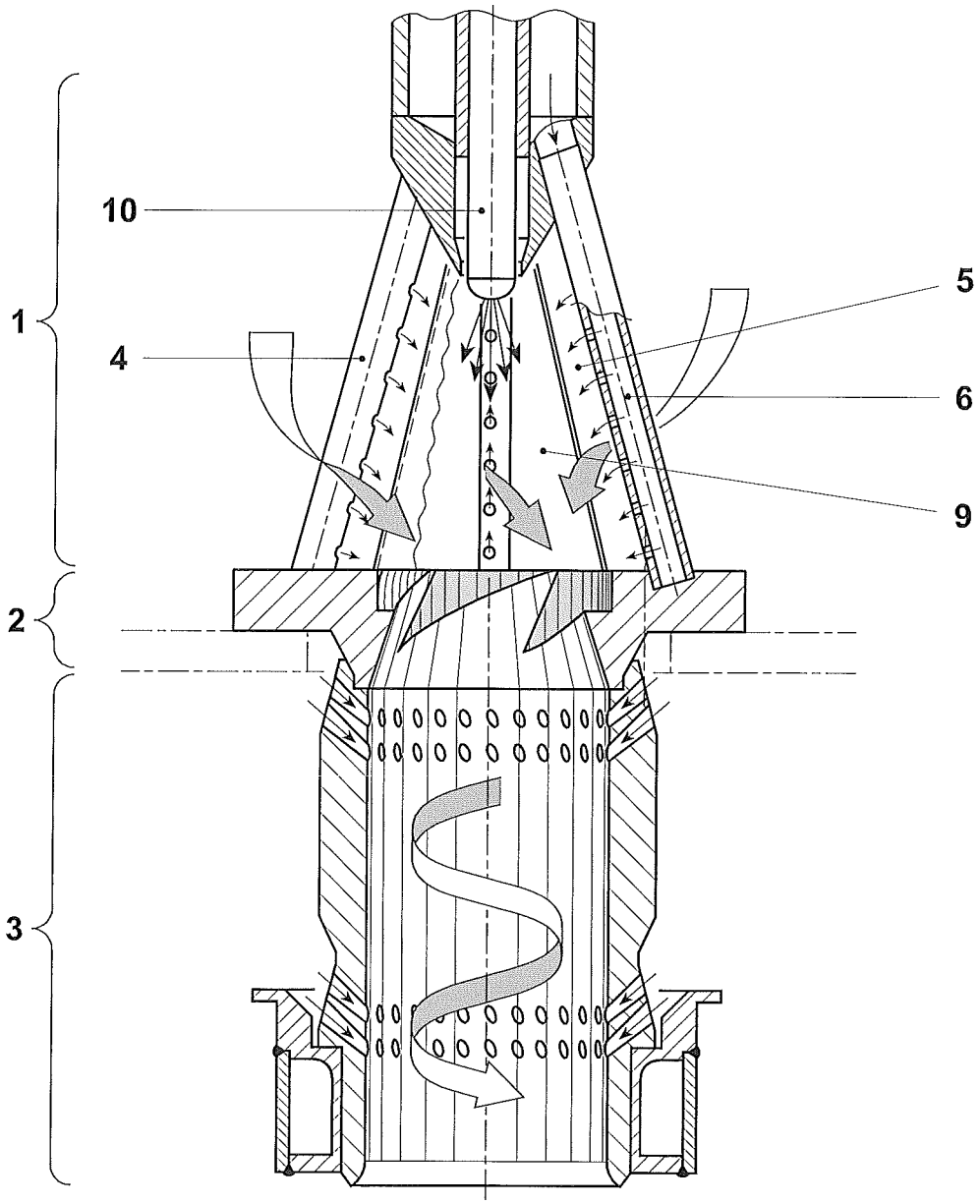
FIG. 1 shows a sectional side view of a generic premix burner.

Exemplary embodiments of the present invention are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiment disclosed herein.

Figure 2:
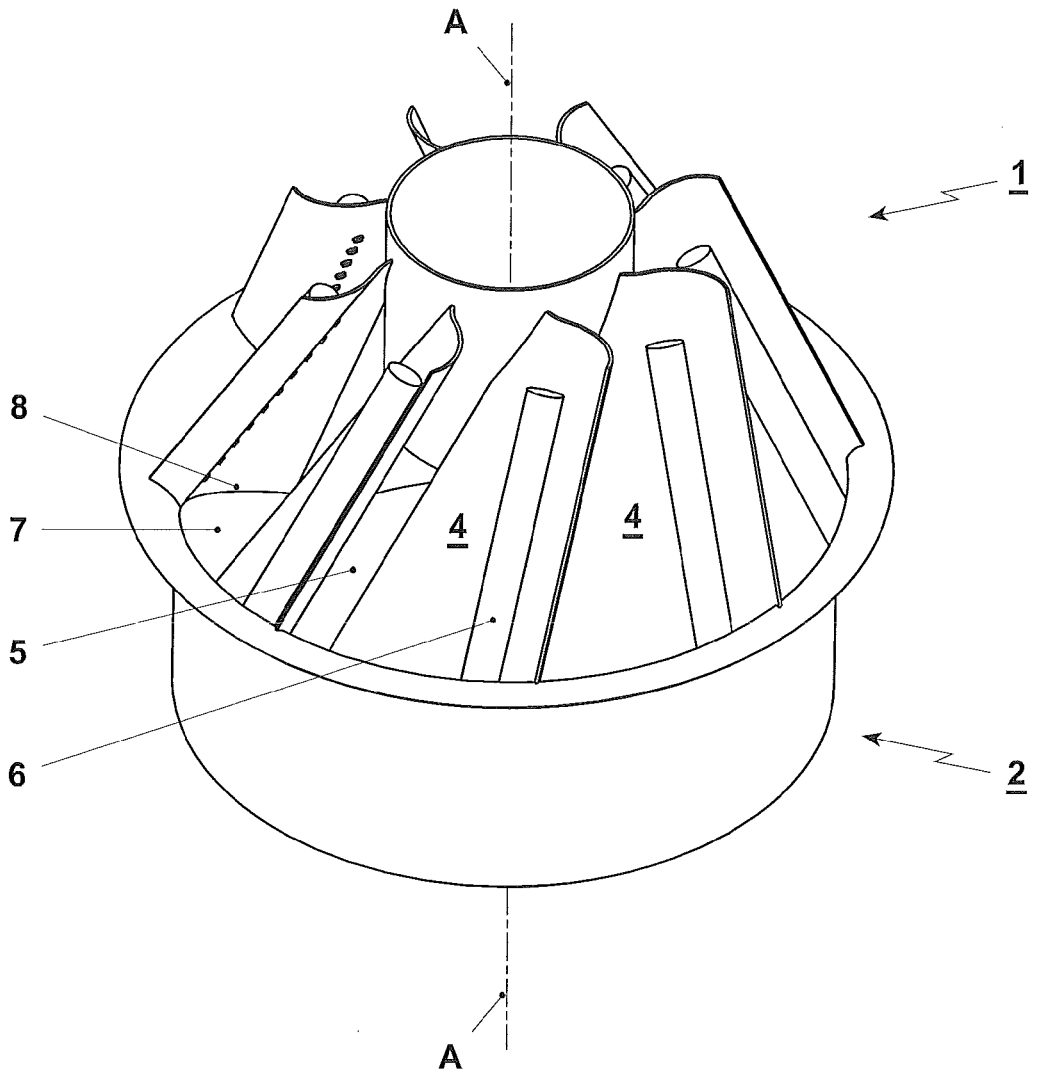
FIG. 2 shows a perspective view of a transition piece according to the state of the art.

FIGS. 1 and 2 show schematically the principle design of a generic premix burner for a heat generator. A field of use for such burners are stationary gas turbines. Said burner consists of a conical swirl generator 1 with at least two hollow conical shells 4 which are nested one inside the other to define a conically expanding interior swirl space 9 and to provide longitudinal slots 5 through which combustion air is tangentially injected into the interior swirl space 9. At the initial part of the swirl space 9 a central fuel lance 10, preferably for injecting a liquid fuel, is accommodated. Arranged along the tangential air-inlet slots 5 the conical sectional shells 4 each have a fuel line 6 with openings for injecting a preferably gaseous fuel into the combustion air flowing through there. The combustion air and fuel, tangentially entering the swirl space 9, generate a swirling flow therein. The swirling flow from the swirl generator 1 is directed into the mixing tube 3. This is done via the transition piece 2, which passes the flow into the adjoining cross-section of the mixing tube 3. A smooth introduction of flow free of losses between swirl generator 1 and mixing tube 3 prevents the direct formation of a backflow zone.

Details of the design of the flow limiting interior contour within the transition section, characterized by a smooth transition from the swirl generator 1 into the mixing tube 3, are shown in FIGS. 3 and 4. The transition piece 2 provides a continuing flow limiting interior contour 12 between an inlet and an outlet without any abrupt inflections. The transition section 2 starts at the leading edges of the shells 4 at the downstream end of the slots 5 in the swirl generator 1. At this point the flow limiting contour 12 enters a radially inwards curved section. The downstream ends of the conical shells 4 adjoin the interior contour 12 in this radially inwards curved section. The maximal gradient 13 of the curved section is at the starting point. In downstream direction the gradient 13 is uniformly declining. When the gradient 13 approaches zero, the effective diameter 16 of the mixing tube 3 is reached.

One variant for a radially inwards curved run of the interior contour 12 is a circular arc profile. An advantage of such a profile is its easy design.

In a preferred embodiment said radially inwards curved section of the flow limiting interior contour 12 extends up to the outlet 15 of the transition piece 2, According to another embodiment the radially inwards curved section of the interior contour 12 ends in a section upstream of the outlet, and from this upstream section the interior contour 12 continues at a constant diameter to the outlet 15.

In every case, at its outlet the interior contour 12 of the transition piece 2 is flush with the interior contour 16 of the mixing tube 3, i.e. transition without a sharp edge or a cross-sectional jump.

The invention claimed is:

1. A premix burner for a heat generator, the premix burner, comprising:

a swirl generator, having at least two burner shells which complement one another to form an axially conically widening swirl space and which mutually define, in an axial cone longitudinal direction, tangential slots through which combustion air is introduced into the swirl space, and a fuel feeder to provide a fuel into the combustion air flow arranged at least in sections along the tangential slots;

a mixing tube downstream of the swirl generator for homogeneously mixing fuel and combustion air before introducing the fuel-air-mixture into a combustion chamber, where ignition occurs;

a transition piece between the swirl generator and the mixing tube for transferring the flow of combustion air and fuel from the swirl generator into the mixing tube, wherein the transition piece comprises an inlet, connected to the swirl generator, an outlet, connected to the mixing tube, and a continuing flow limiting interior contour between said inlet and said outlet, wherein at least in an inlet section said interior contour is curved radially inwards towards the inner diameter of the mixing tube and wherein at the outlet, the interior contour is flush with an interior flow limiting contour of the mixing tube, wherein the radially inwards curved contour has a gradient which declines in a downstream direction, the maximal angle for the gradient being located at the inlet, wherein said radially inwards curved section of interior contour extends from the inlet of the transition piece up to its outlet.

2. The premix burner according to claim 1, wherein said radially inwards curved interior contour of the transition piece starts at the downstream end of the swirl generator from the leading edge of the slots.

3. The premix burner according to claim 1, wherein the interior contour at the inlet section of the transition piece is equipped with a concave shape.

4. The premix burner according to claim 1, wherein the interior contour at the inlet section of the transition piece is equipped with a circular arc profile.

5. The premix burner according to claim 4, wherein said circular arc profile section includes a central angle ($\mu$) and wherein $\mu \leq 90°$.

6. The premix burner according to claim 5, wherein $\mu \leq 45°$.

7. The premix burner according to claim 1, wherein the transition piece is an integral part of the swirl generator.

8. A transition piece for a premix burner, the premix burner including a swirl generator, having at least two burner shells which complement one another to form an axially conically widening swirl space and which mutually define, in axial cone longitudinal direction, tangential slots through which combustion air is introduced into the swirl space, and a fuel feeder that provides a fuel into the combustion air flow arranged at least in sections along the tangential slots, said transition piece comprising:

a casing with an inner passage, an inlet, an outlet and a continuing flow limiting interior contour between said inlet and said outlet, wherein at least in the inlet section said interior contour is curved radially inwards, wherein the transition piece is designed to be connected to the outlet of the swirl generator of this premix burner, wherein the radially inwards curved contour has a gradient which declines in a downstream direction, the maximal angle for the gradient is located at the inlet, wherein the radially inwards curved inlet section extends from its inlet up to its outlet.

9. The transition piece according to claim 8, wherein at least in the inlet section the interior contour is equipped with a concave shape.

10. The transition piece according to claim 8, wherein at least in the inlet section the interior contour is equipped with a circular arc profile.

11. The transition piece according to claim 10, wherein said circular arc profile includes a central angle ($\mu$) and wherein $\mu \leq 90°$.

12. The transition piece according to claim 10, wherein $\mu \leq 45°$.

* * * * *